US009233793B1

(12) United States Patent
Jackson et al.

(10) Patent No.: US 9,233,793 B1
(45) Date of Patent: Jan. 12, 2016

(54) LID LIFTING DEVICE FOR RESIDENTIAL USE

(71) Applicant: Original Design Products LLC, Westlake Village, CA (US)

(72) Inventors: Michael Jackson, Agoura Hills, CA (US); John Christie, Westlake Village, CA (US)

(73) Assignee: Original Design Products, LLC, Westlake Village, CA (US)

( * ) Notice: Subject to any disclaimer, the term of this patent is extended or adjusted under 35 U.S.C. 154(b) by 0 days.

(21) Appl. No.: 14/556,864

(22) Filed: Dec. 1, 2014

(51) Int. Cl.

| | |
|---|---|
| ***B65F 1/14*** | (2006.01) |
| ***B65D 43/24*** | (2006.01) |
| ***B65D 43/26*** | (2006.01) |
| *B65F 1/16* | (2006.01) |

(52) U.S. Cl.
CPC . *B65F 1/14* (2013.01); *B65D 43/24* (2013.01); *B65D 43/26* (2013.01); *B65F 1/1646* (2013.01); *B65F 2001/1669* (2013.01)

(58) Field of Classification Search
CPC ..... B65F 1/163; B65F 1/1623; B65F 1/615; B65F 1/14; B65F 1/1646; B65F 2001/1669; B65D 43/24; B65D 43/26; B65D 43/262; B65D 43/265
See application file for complete search history.

(56) References Cited

U.S. PATENT DOCUMENTS

| | | | | |
|---|---|---|---|---|
| 1,203,987 | A * | 11/1916 | Davis | 220/264 |
| 5,584,081 | A * | 12/1996 | Ouelette | 4/498 |
| 6,859,952 | B2 * | 3/2005 | Perry | 4/498 |
| 8,074,324 | B2 * | 12/2011 | Warren et al. | 16/372 |

* cited by examiner

*Primary Examiner* — Andrew Perreault

(57) ABSTRACT

An apparatus and method for easily and simply lifting and holding open residential size trash containers thereby allowing the user the use of both hands for hoisting and dumping the trash without having to touch the lid with bare or both hands. The device also holds the lid in an open position without having to rest the lid against a wall or abutment or having the lid completely flip to the back side of the receptacle through the hinge.

4 Claims, 7 Drawing Sheets

LID LIFTING DEVICE FOR RESIDENTIAL USE

BACKGROUND OF THE INVENTION

1. Field of the Invention

The field of this invention is devices for assisting in opening a residential style trash can lid and keeping it open and more particularly toward a handle that can be attached to the trash containers that can cause the lid to be opened without the hands having to touch the often and usually unhygienic lid. The device also provides a means to prop the lid open while transferring refuse into the garbage can and can be closed when finished without having to touch the trash can lid with bare hands.

2. Description of the Prior Art

Trash containers used in residential dwellings are convenient and suited well for pickup from garbage trucks. Typically, there is a receptacle with a substantially square or rectangular shaped opening at the top that has a lid attached to it. The lid is usually attached to one side of the square opening through hinges that allow the lid to move from the open and closed positions without having to be removed completely from the trash can. The lid covers the receptacle to keep the trash and odors in and to keep rain, debris, animals and any other unwanted items out.

When transferring garbage into the trash container the user typically must open the lid with his or her hands and either flip the lid entirely over along the hinge to place the garbage therein or hold the lid open with his or her free hand.

This process leads to a hygiene and a hands-free problem as the lid can be contaminated with foul refuse that has been thrown therein or difficult to lift the lid while carrying trash or one or more trash bags in one or both hands. It is the object of the instant invention to provide a simple device and method of opening the lid without the use of bare or both hands and also the option of keeping the lid open while in use and closing easily thereafter thereby removing the necessity of having to touch the container with bare or both hands. This reduces the unpleasant hygienic side effect of handling refuse which can range from foul odor to potential illness-inducing germs coming into contact with the user's hands. Furthermore, it is a further object of the instant invention to provide a device that is separate from the lid and that can be more easily kept clean and adapted to any other similarly shaped and sized trash receptacle.

SUMMARY OF THE INVENTION

The instant invention defines an apparatus to aid in the lifting a lid to a receptacle and maintaining it in the open position comprising: a first base member having a first end and a second end; a second base member substantially parallel to said first base member having a first end and a second end; a connecting member connecting said first base member and said second base member at said first end of said first base member and said first end of said second base member wherein said connecting member is affixed to said lid of said receptacle at the point where said connection member connects to said first end of said first base member and said first end of said second base member; a first connecting member attached to said first base member at said second end; a second connecting member attached to second base member at said second end wherein said first connecting member and said connecting member are substantially parallel and extend from said first and second base members at an upward obtuse angle; a handle portion connecting said first connecting member and said second connecting member.

The above embodiment can be further modified by defining that there is a first slightly fanned movable member that rests at the junction between said second end of said first base member and said first connecting member and a second slightly fanned movable shaped member rests at the junction between said second end of said second base member and said second connecting member.

A second embodiment of the instant invention defines a method for opening the lid of a trash can receptacle comprising; obtaining a trash can receptacle with an attached lid attached at a hinge that has a substantially square or rectangular shaped top defined by the four walls of said trash can receptacle; attaching an apparatus to said substantially rectangular shaped top said apparatus further comprising: a first base member having a first end and a second end; a second base member substantially parallel to said first base member having a first end and a second end; a connecting member connecting said first base member and said second base member at said first end of said first base member and said first end of said second base member wherein said connecting member is affixed to said lid of said receptacle at the point where said connection member connects to said first end of said first base member and said first end of said second base member; a first connecting member attached to said first base member at said second end; a second connecting member attached to second base member at said second end wherein said first connecting member and said connecting member are substantially parallel and extend from said first and second base members at an upward obtuse angle; a handle portion connecting said first connecting member and said second connecting member; pushing said handle in a downward direction thereby causing said first and second connecting members to exert force on said first and second base members in a direction toward said hinge thereby causing said main base members to force open said lid in said upward direction.

The above embodiment can be further modified by defining that a first slightly fanned movable member rests at the junction between said second end of said first base member and said first connecting member and a second slightly fanned movable member rests at the junction between said second end of said second base member and said second connecting member.

BRIEF DESCRIPTION OF THE DRAWINGS

For a better understanding of the present invention, reference is to be made to the accompanying drawings. It is to be understood that the present invention is not limited to the precise arrangement shown in the drawings.

DETAILED DESCRIPTION OF A PREFERRED EMBODIMENT

Figure 1:
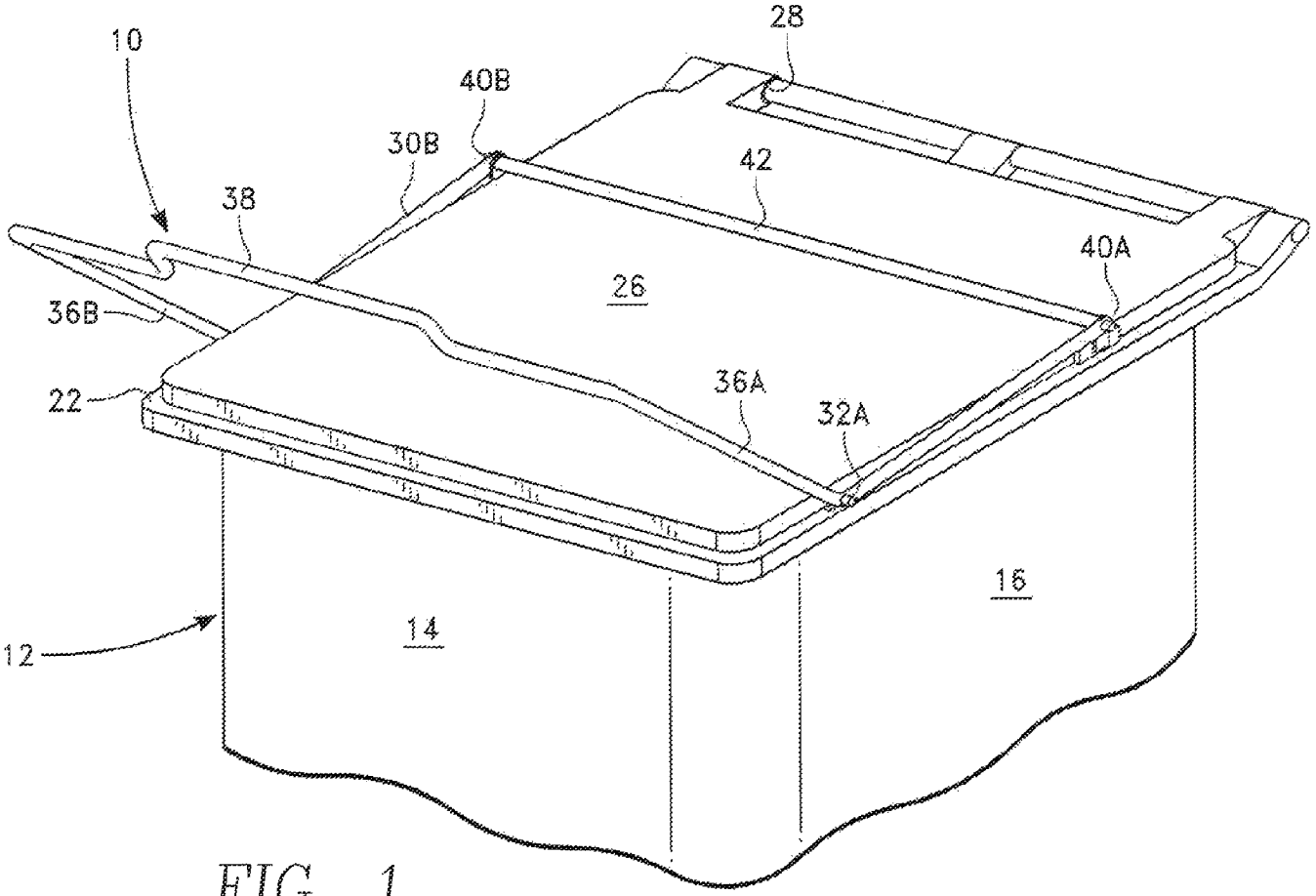
FIG. 1 is a top perspective view of the device as it is placed on the top of a typical residential trash can receptacle in the closed lid position.

Turning to the drawings, the preferred embodiment is illustrated and described by reference characters that denote similar elements throughout the several views of the instant invention.

The preferred embodiment is an apparatus 10 that is attachable to the lid 26 of a residential size trash receptacle 12. The device can be fabricated as a single piece via injection molding or as multiple pieces that are welded together if metal is the material used. The trash receptacle 12 has four walls 14, 16, 18, 20 that define a substantially square or rectangular shape. The trash receptacle 12 has a closed bottom and an open top 24 that is defined by a top perimeter 22 where the four walls 14, 16, 18, 20 meet. This top perimeter 22 is covered by a lid 26 that is movable along a hinge 28 that allows the lid 26 to be opened and closed without having to detach the lid 26.

Figure 5:
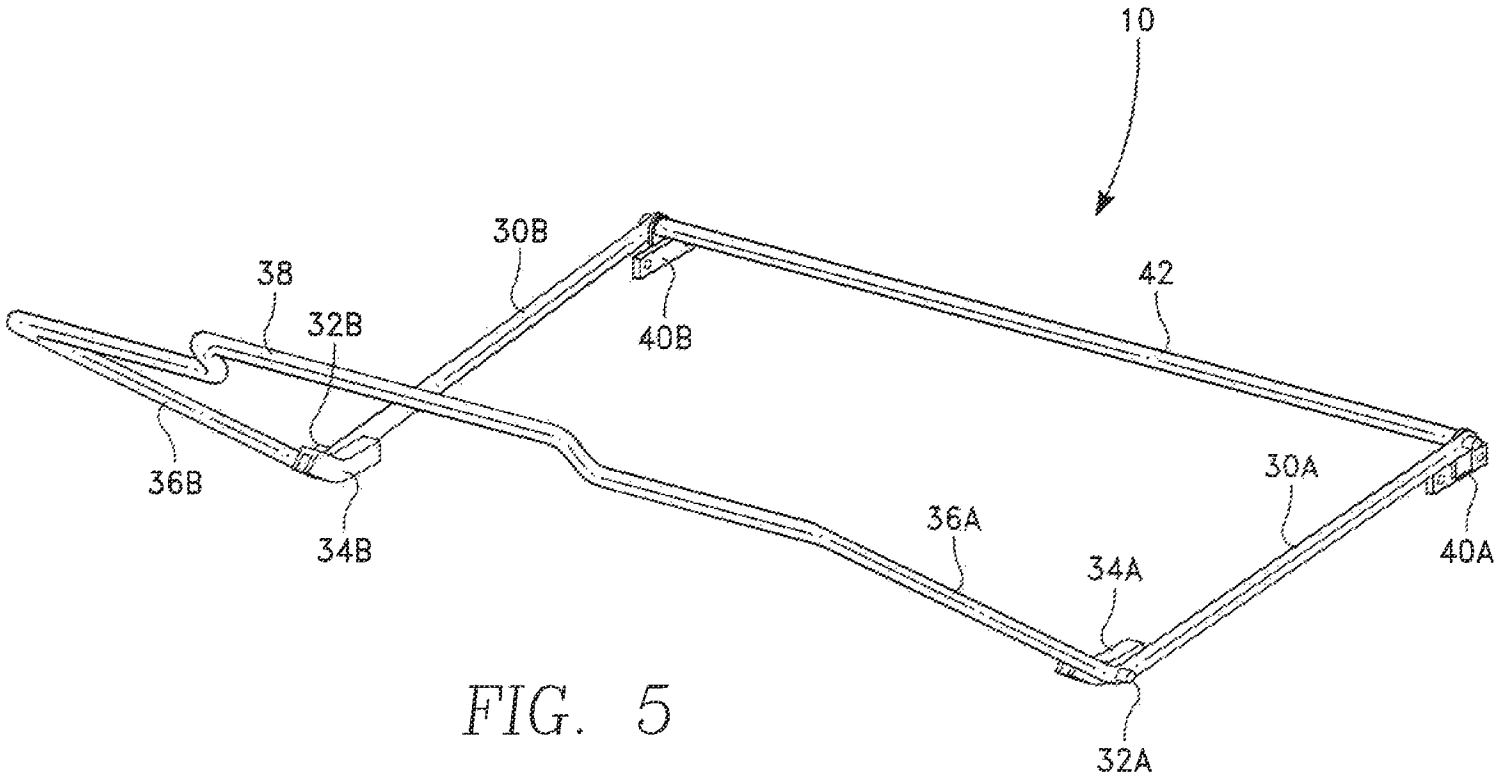
FIG. 5 is a top perspective view of the device not attached to a trash can.
Figure 6A:
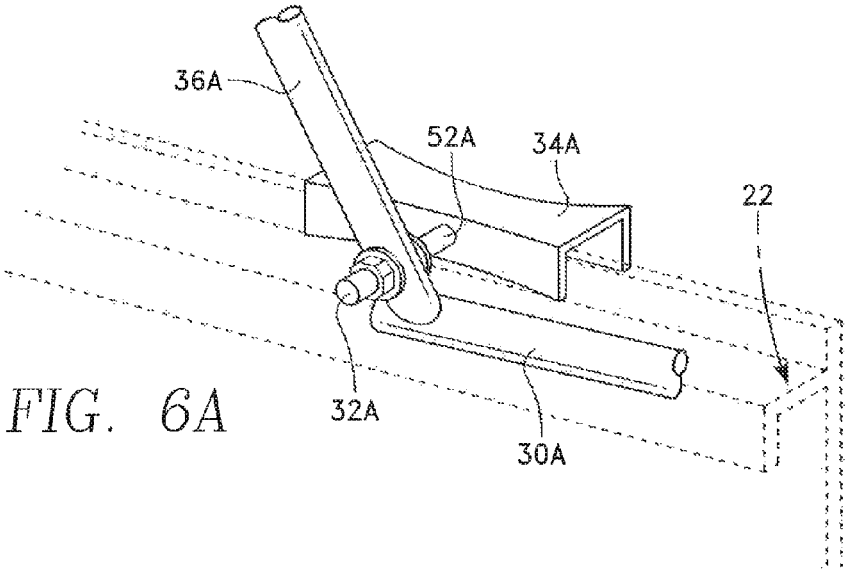
FIG. 6A is a close up view of the movable portion of the device as it slides along the top perimeters of the trash can.

The device 10 of the instant invention is a device that slides along the perimeter 22 and is affixed to the lid 26. The device 10 standing alone is seen in FIG. 5. The portion that slides along the perimeter is shown in close up in FIG. 6A. The portion that is affixed to the lid is shown in close up in FIG. 6B. The device 10 exists in two planes. The first plane has a first base member 30A and a second base member 30B, each base member having a first end and a second end that are parallel to each other and connected through a first connecting member 42. At the intersection of the first connecting member 42 and each base member 30A, 30B are securing means that allow the first connecting member 42 to be firmly affixed to the lid. 26 of the trash receptacle but can be removed when needed (See FIGS. 1, 6A and 6B). The first and second base members 30A, 30B are movable and are adjacent and parallel to the perimeter 22 of the trash can receptacle 12. On the opposite side of each base member 30A, 30B from where they attach to the first connecting member 42 are the slightly fanned movable portions 34A, 34B that slide along the perimeter 22 and that are attached to the connection points 32A, 32B between the base members 30A, 30B and the second connecting member 36A and third connecting member 36B. The movable portions 34A, 34B glide along both side of perimeter 22 of the trash can receptacle when deployed.

As illustrated, these slightly fanned movable portions 34A, 34B have something of a butterfly, slightly fanned shape. It is to be understood however that these movable portions 34A, 34B can have any shape that allows it to operate in the way intended. The movable pieces 34A, 34B are 2½ inches long and are designed with a smooth bottom that gradually fans out from a ½ wide center to a 1 inch wide at each end and has ½ inch sides along the side slightly fanned perimeters. The slightly fanned movable portions 34A, 34B are arched at approximately 15 degrees to allow them to rock back and forth and slide on the trash can perimeter 12. The slightly fanned movable portions 34A, 34B are attached via connector bars 52A, 52B one inch from the joint angle connecting the base members 30A, 30B and second and third connecting members 36A, 36B. The connector bars 52A, 52B allow the movable portions 34A, 34B to rock back and forth when sliding along perimeter 22. The connector bars 52A, 52B have a stop to keep the slightly fanned movable portions 34A, 34B from rocking or rotating past the 15 degrees angle needed for the movable portions 34A, 34B to be able to rock and slide smoothly along perimeter 22.

Figure 7:
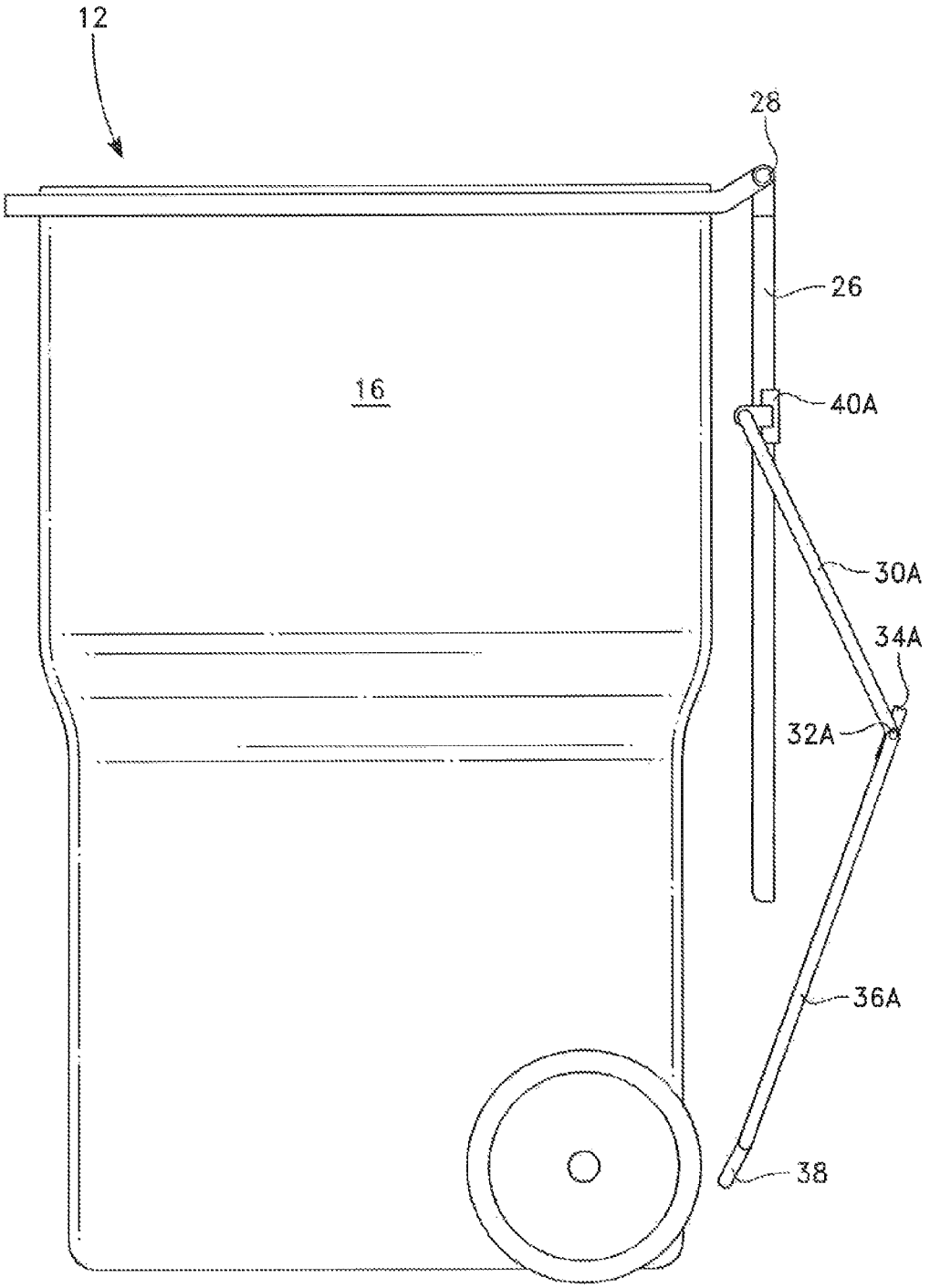
FIG. 7 is a side view of a trash can with the device attached thereto where it is folded all the way along the hinge connecting the lid to the trash can and clearing (not touching) the trash can wheels, thereby leaving the entire opening exposed where the lid is not held in the upright position.

Attached to each movable end 32A, 32B is a connecting member 36A and a third connecting member 36B that extend upward at an obtuse angle from the base members 30A, 30B. The second and third connecting members 36A, 36B are parallel to each other and terminate in a connection member that acts as a handle 38 that is shaped in a position so that when lid is fully open, as seen in FIG. 7, the device 10 does not hit the ground or the wheels 50 of the trash can receptacle 12.

FIG. 1 shows a view of a trash can receptacle 12 with the device 10 attached thereto while in the closed position. As shown, the base members 30A, 30B rest along the perimeter 22 while the first connecting member 42 is attached through attachment means such as nuts and bolts to the lid 26 of the trash can receptacle 12. The second and third connecting members 36A, 36B extend upward from the lid 26 at an angle that allows the user to grip the handle 38 to deploy the opening feature.

Figure 2:
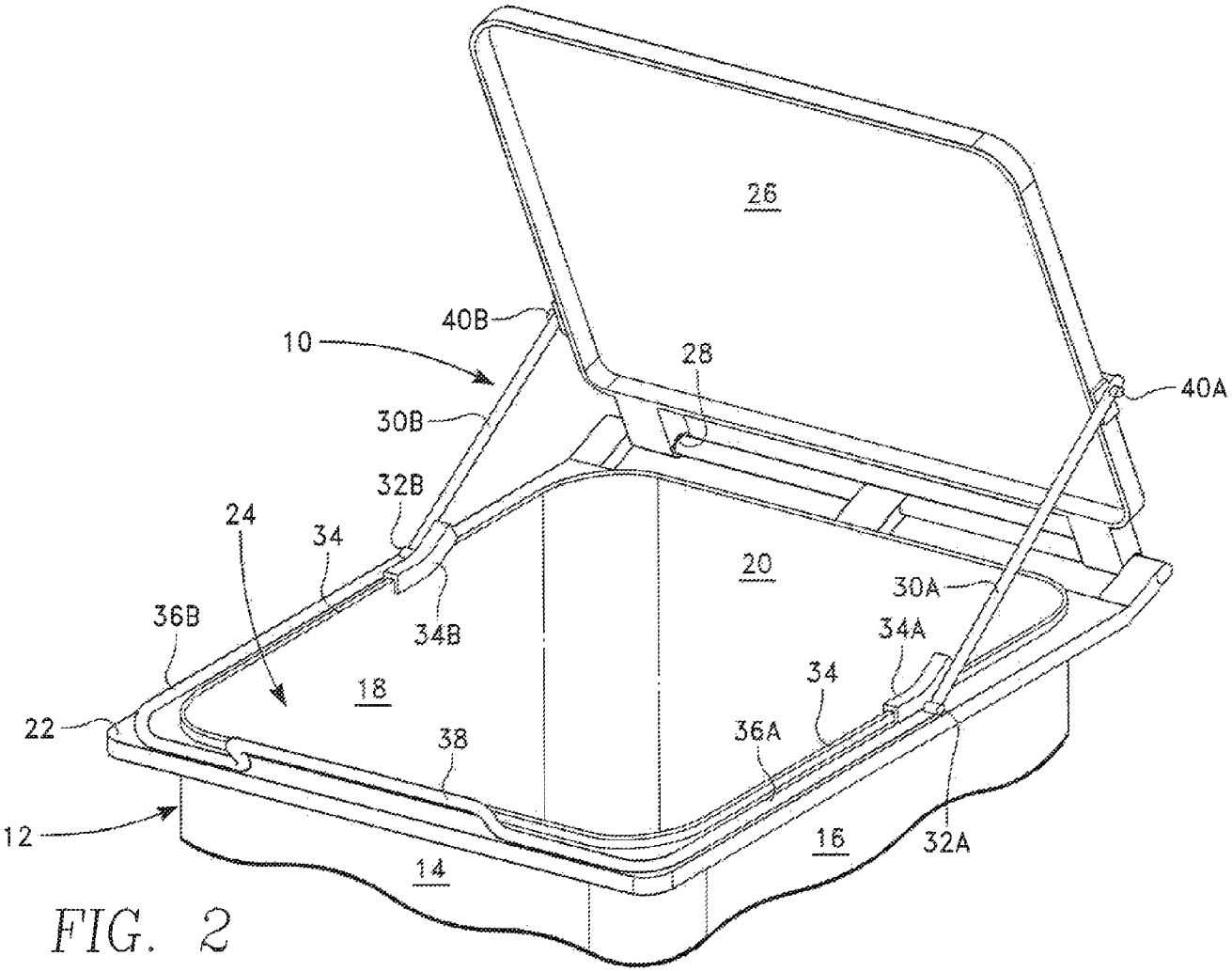
FIG. 2 is a top perspective view of the device as it is placed on the top of a typical residential trash can receptacle in the open lid position.
Figure 4A:
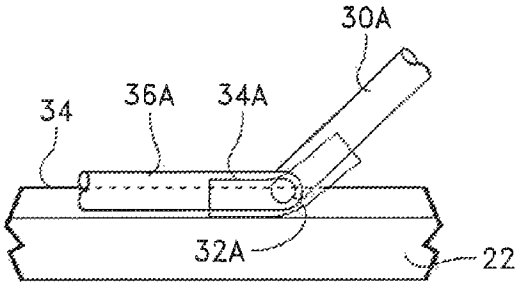
FIG. 4A is a close-up side view of the moving portion and the slightly fanned shaped member when in the open position.
Figure 3A:
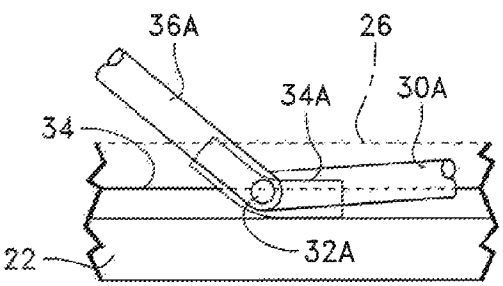
FIG. 3A is a close-up side view of the moving portion and slightly fanned member when in the closed position.
Figure 3:
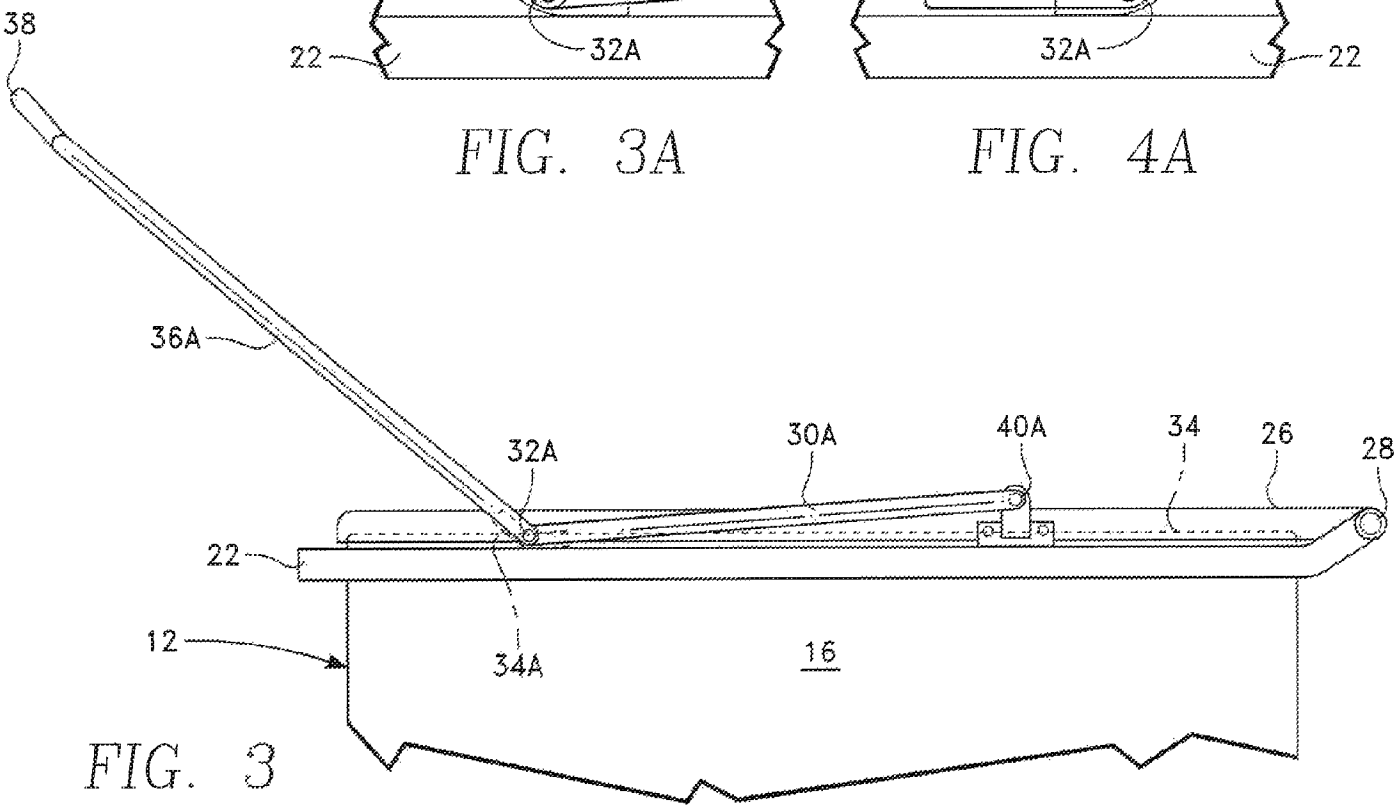
FIG. 3 is a side view of the device as it is placed on the top of a typical residential trash can receptacle in the closed lid position.
Figure 4:
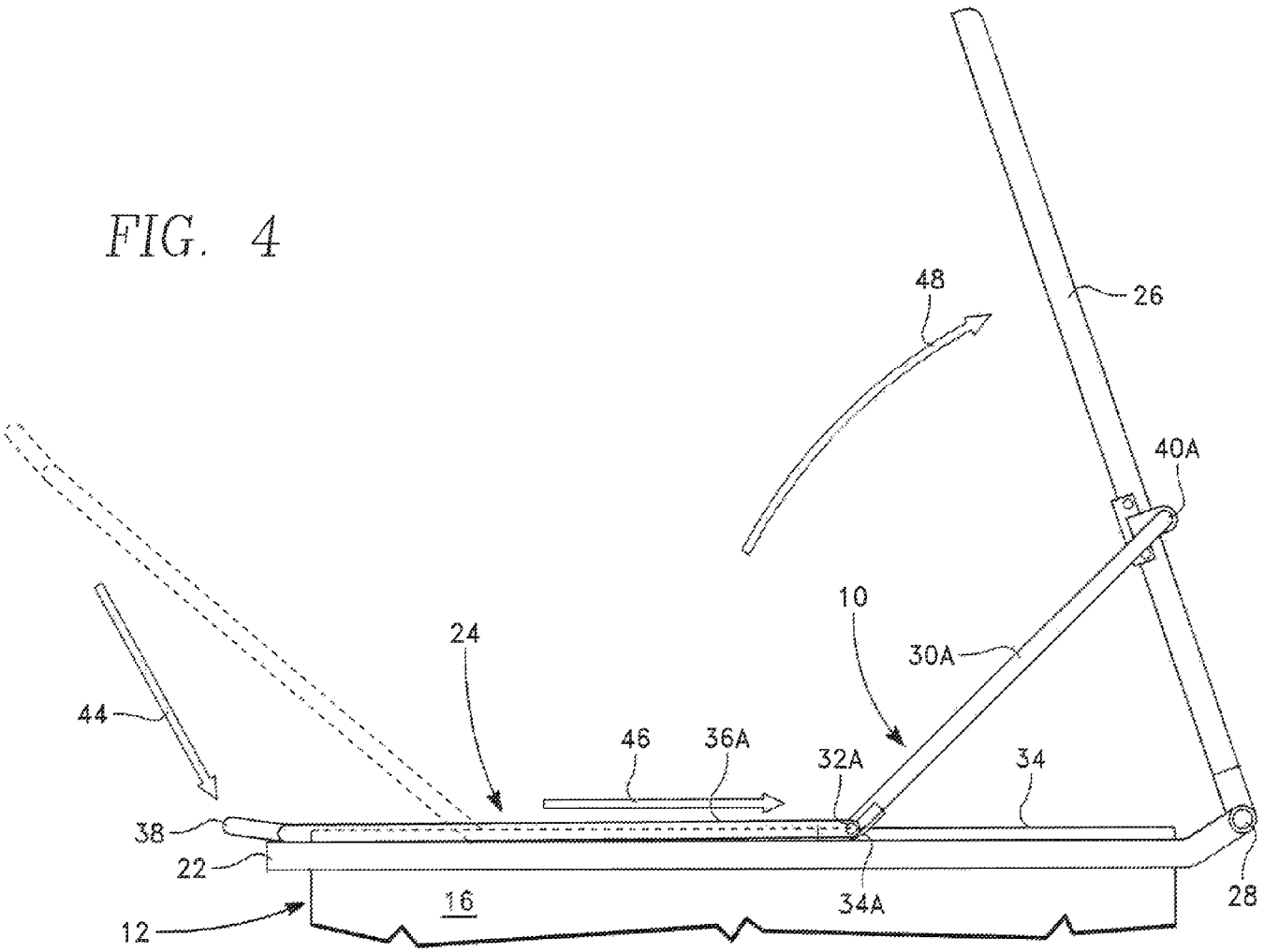
FIG. 4 is a side view of the device as it is placed on the top of a typical residential trash can receptacle in the open lid position showing the closed position in phantom.

FIG. 2 shows the trash can receptacle 12 with an open lid. 26 after having been deployed. FIGS. 3-4A show side views of the device 10 on the trash can receptacle 12 in both the open and closed positions. FIG. 4 shows the operation of the deployment demonstrated through the illustrated arrows. To deploy, the user grips the handle 38 and moves it downward 44. This movement causes the second and third connecting members 36A, 36B to slide along the perimeter 22 in a direction 46 toward the hinge 28 hinge connecting the lid 26 to the trash can receptacle 12. This movement along the perimeter 22 toward the hinge 28 cause the main base members 30A, 30B to move in an upward direction 48 thereby pushing the lid 26 open and exposing the open top 24 of the trash can receptacle 12. As seen in FIG. 7, the trash can lid 26 can also pass further past the top portion 24 of the trash can 12 by pushing the handle 38 in the direction 48 toward the hinge to the point that the lid 26 moves past the hinge 28 and rests along the back wall 20 of the trash can receptacle 12 without it hitting the ground or the wheels 50 of the trash can 12.

Figure 6B:
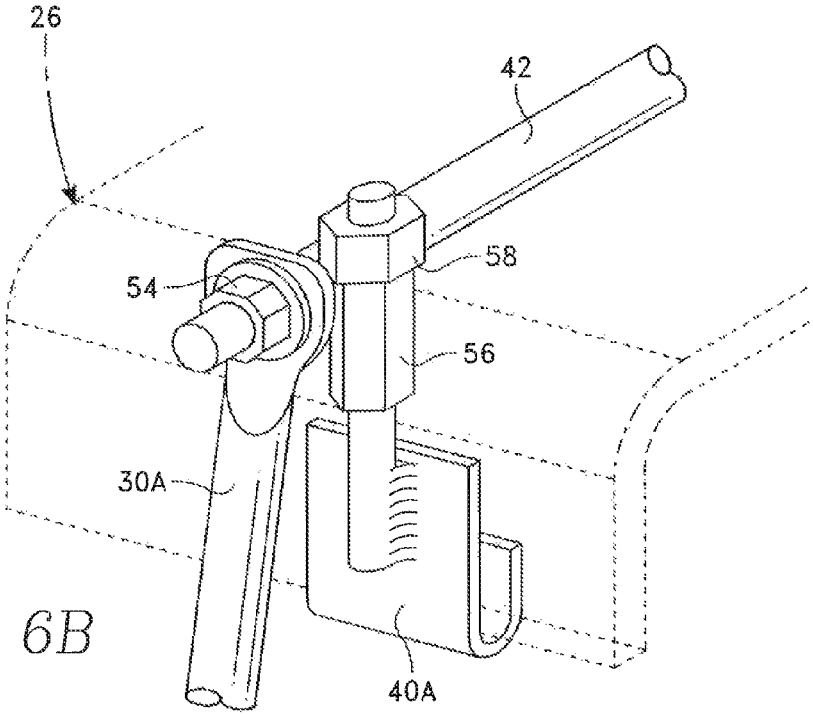
FIG. 6B is a close up view of the attachment portion of the device as it attaches to the lid of the trash can.

The device 10 attaches to the lid 26 of the trash can in a non-movable fashion, seen in close up in FIG. 6B. The base member 30A connects with the first connecting member 42 and is secured thereto with a nut 54. Attached to the first connecting member 42 is a separate piece 56 that is also secured by a nut 58 and that terminates in a hook-shaped piece 40A that secures the third member 42 to the lid 26. It is to be understood however that the securing nuts 54, 58 can be redesigned to allow multiple ways of securing a connection to member 42 and the hooked shaped piece 40A.

The discussion included in this patent is intended to serve as a basic description. The reader should be aware that the specific discussion may not explicitly describe all embodiments possible and alternatives are implicit. Also, this discussion may not fully explain the generic nature of the invention and may not explicitly show how each feature or element can actually be representative or equivalent elements. Again, these are implicitly included in this disclosure. Where the invention is described in device-oriented terminology, each element of the device implicitly performs a function. It should also be understood that a variety of changes may be made without departing from the essence of the invention. Such changes are also implicitly included in the description. These changes still fall within the scope of this invention.

Further, each of the various elements of the invention and claims may also be achieved in a variety of manners. This disclosure should be understood to encompass each such variation, be it a variation of any apparatus embodiment, a method embodiment, or even merely a variation of any element of these. Particularly, it should be understood that as the disclosure relates to elements of the invention, the words for each element may be expressed by equivalent apparatus terms even if only the function or result is the same. Such equivalent, broader, or even more generic terms should be considered to be encompassed in the description of each element or action. Such terms can be substituted where desired to make explicit the implicitly broad coverage to which this invention is entitled. It should be understood that all actions may be expressed as a means for taking that action or as an element which causes that action. Similarly, each physical element disclosed should be understood to encompass a disclosure of the action which that physical element facilitates. Such changes and alternative terms are to be understood to be explicitly included in the description.

What is claimed is:

1. An apparatus to aid in the lifting and closing of a lid to a residential trash receptacles and maintaining said lids in the open position, said apparatus comprising:

a trash receptacle having a main body, a lid with a front end from which said lid opens, a back end that connects said lid to said trash receptacle via a hinge that keeps said lid and said receptacle affixed, a left side and a right side;

a first base member having a corresponding first end and a second end;

a second base member substantially parallel to said first base member having a corresponding first end and a second end;

a first connecting member connecting said first base member and said second base member at said corresponding first end of said first base member and said corresponding first end of said second base member wherein said connecting member is affixed to said lid of said receptacle at said corresponding first end of said first base member and said corresponding first end of said second base member;

a second connecting member attached to said first base member at said corresponding second end;

a third connecting member attached to said second base member at said corresponding second end wherein said second connecting member and said third connecting members are substantially parallel and extend from said first base member and said second base members at an upward obtuse angle;

a handle portion connecting said second connecting member and said third connecting member;

a first slightly fanned lifting arm slide that rests on said left side of said trash receptacle and a second slightly fanned lifting arm slide that rests on said right side of said trash receptacle and wherein said first slightly fanned lifting arm slide is attached to said second end of said second base member and said second slightly fanned lifting arm slide is attached to said second end of said first base member.

2. The apparatus of claim 1 wherein said first end of said first base member and said first connecting member are connected to said lid with a first nut and secured thereto and a first separate piece is attached to said first connecting member and said first base member and secured thereto with a second nut wherein said first special piece terminates in a first hook-shaped piece that secures said first connecting member thereto and wherein said second base member and said first connecting member are connected to said lid with a third nut and secured thereto and a second separate piece is attached to said first connecting member and said second base member and secured thereto with a fourth nut wherein said second special piece terminates in a second hook-shaped piece that secures said first connecting member thereto.

3. A method for opening the lid of a trash can receptacle comprising;

obtaining a trash can receptacle having a main body, a lid with a front end from which said lid opens, a back end that connects said lid to said trash receptacle via a hinge that keeps said lid and said receptacle affixed, a left side and a right side;

attaching an apparatus to said substantially square or rectangular shaped top said apparatus further comprising:

a first base member having a corresponding first end and a second end;

a second base member substantially parallel to said first base member having a corresponding first end and a second end;

a first connecting member connecting said first base member and said second base member at said corresponding first end of said first base member and said corresponding first end of said second base member wherein said connecting member is affixed to said lid of said receptacle at said corresponding first end of said first base member and said corresponding first end of said second base member;

a second connecting member attached to said first base member at said corresponding second end;

a third connecting member attached to said second base member at said corresponding second end wherein said second connecting member and said third connecting members are substantially parallel and extend from said first base member and said second base members at an upward obtuse allele;

a handle portion connecting said second connecting member and said third connecting member;

a first slightly fanned lifting arm slide that rests on said left side of said trash receptacle and a second slightly fanned lifting arm slide that rests on said right side of said trash receptacle and wherein said first slightly fanned lifting arm slide is attached to said second end of said second base member and said second slightly fanned lifting arm slide is attached to said second end of said first base member asserting downward force on said first and second lifting arm sliders to slide along the said right and left sides of said trash receptacle towards said receptacle's back hinged side while simultaneously causing said first base member and second base member to push said lid in an upward direction until said first connecting member and said handle causes said lid to stop.

4. The method of claim 3 wherein said first end of said first base member and said first connecting member are connected, to said lid with a first nut and secured thereto and a first separate piece is attached to said first connecting member and said first base member and secured thereto with a second nut wherein said first special piece terminates in a first hook-shaped piece that secures said first connecting member thereto and wherein said second base member and said first connecting member are connected to said lid with a third nut and secured thereto and a second separate piece is attached to said first connecting member and said second base member and secured thereto with a fourth nut wherein said second special piece terminates in a second hook-shaped piece that secures said first connecting member thereto.

* * * * *